US008707623B2

(12) United States Patent
Mori et al.

(10) Patent No.: US 8,707,623 B2
(45) Date of Patent: Apr. 29, 2014

(54) WINDOW REGULATOR ASSEMBLY INCLUDING A MECHANISM FOR SECURING A LIFT ARM TO A DRIVE MECHANISM

(75) Inventors: Masatoshi Mori, Columbus, OH (US); Kenichi Kitayama, Tochigi (JP)

(73) Assignee: Honda Motor Co., Ltd., Tokyo (JP)

( * ) Notice: Subject to any disclaimer, the term of this patent is extended or adjusted under 35 U.S.C. 154(b) by 199 days.

(21) Appl. No.: 12/821,252

(22) Filed: Jun. 23, 2010

(65) Prior Publication Data

US 2011/0314740 A1 Dec. 29, 2011

(51) Int. Cl.
*E05F 15/08* (2006.01)

(52) U.S. Cl.
USPC ..... 49/349; 49/348; 49/350; 49/351; 49/372

(58) Field of Classification Search
USPC ..... 49/348–351, 372, 502
See application file for complete search history.

(56) References Cited

U.S. PATENT DOCUMENTS

| | | | | |
|---|---|---|---|---|
| 1,552,419 | A | | 9/1925 | Clas |
| 1,797,786 | A | | 9/1927 | Nicholson |
| 2,417,534 | A | | 3/1945 | Wilkison |
| 3,354,582 | A | | 11/1967 | Lystad |
| 3,495,357 | A | | 2/1970 | Henry-Biabaud |
| 3,816,962 | A | | 6/1974 | Ladd et al. |
| 3,859,753 | A | | 1/1975 | Marcuzzi |
| 3,897,652 | A | | 8/1975 | Hess |
| 4,026,088 | A | | 5/1977 | Akabane |
| 4,177,606 | A | * | 12/1979 | Jeavons et al. ..... 49/351 |
| 4,939,867 | A | * | 7/1990 | Harada et al. ..... 49/349 |
| 4,986,029 | A | * | 1/1991 | Richter ..... 49/349 |
| 5,079,871 | A | * | 1/1992 | Acciacca et al. ..... 49/351 |
| 5,111,715 | A | * | 5/1992 | Farris ..... 74/606 R |
| 5,497,578 | A | * | 3/1996 | Wautelet et al. ..... 49/349 |
| 5,513,468 | A | * | 5/1996 | Diestelmeier ..... 49/375 |
| 5,595,025 | A | * | 1/1997 | MacPhail-Fausey ..... 49/351 |
| 6,279,269 | B1 | | 8/2001 | Isomura et al. |
| 6,412,222 | B1 | | 7/2002 | Hashiba et al. |
| 6,502,352 | B1 | | 1/2003 | Bonduel |
| 6,910,730 | B2 | * | 6/2005 | Kinoshita et al. ..... 296/146.16 |
| 6,912,811 | B2 | | 7/2005 | Kawashima et al. |
| 7,010,883 | B2 | * | 3/2006 | Jaerpsten et al. ..... 49/351 |
| 7,052,073 | B2 | | 5/2006 | Ichinose et al. |
| 2004/0216382 | A1 | * | 11/2004 | Jaerpsten et al. ..... 49/351 |
| 2007/0209282 | A1 | | 9/2007 | Nunez Subinas |
| 2009/0188168 | A1 | * | 7/2009 | Shirai et al. ..... 49/349 |

* cited by examiner

*Primary Examiner* — Katherine Mitchell
*Assistant Examiner* — Marcus Menezes
(74) *Attorney, Agent, or Firm* — Fay Sharpe LLP

(57) ABSTRACT

A window opening device for use in an automobile door. The device including a motor having a drive gear comprised of a tooth region and a head region. The diameter of the head region is greater than the diameter of the tooth region. A sector gear engages the tooth region and the head region overlaps the sector gear. A first lever arm has a drive end engaging the sector gear and a window end engaging a window. The motor is secured to a body plate configured for mounting to a door. The body plate includes an opening through which the drive gear passes to facilitate engagement with the sector gear.

21 Claims, 3 Drawing Sheets

WINDOW REGULATOR ASSEMBLY INCLUDING A MECHANISM FOR SECURING A LIFT ARM TO A DRIVE MECHANISM

BACKGROUND

The present disclosure relates generally to a regulator assembly for a motor vehicle window. More particularly, it relates to regulator assembly including a mechanism for securing a lifting arm to a drive mechanism.

A window regulator assembly typically includes a pair of pivotally interconnected lifting arms which operate within a door panel of a vehicle in the manner of a scissors linkage. A toothed segment associated with one lifting arm and a pinion operatively connected to a drive mechanism (motor or handle) cooperate such that rotation of the pinion effects pivotal movement of the lifting arm to open or close the window.

FIG. 1 depicts the regulator assembly of U.S. Pat. No. 4,177,606 which includes a main lifting arm 10. The main arm 10 is pivotally connected to a second arm which is formed in two portions 12 and 13, one disposed on each side of the main arm 10 and each provided at its free end with a roller 14, 21 respectively. The arm portions 12 and 13 are interconnected by a pin or rivet 22 passing through an aperture in the main arm 10 such that they remain in alignment during pivotal movement thereof relative to the main arm 10, so that the arms function in the manner of a scissors linkage to raise and lower a vehicle window associated with the rollers 21 and 14 upon relative pivotal movement between the arms.

A panel plate 15 is attached to the main arm 10 by means of a pivot pin 16 to which a clinch nut is secured, the pivot pin also being used to attach the panel plate 15 to a vehicle door panel with the main arm 10 sandwiched between the panel plate 15 and the door panel. The panel plate 15 is also provided with a pair of apertures to receive fasteners 17 including clinch nuts to provide a 3-point mounting for the panel plate 15.

At the lower end of the main arm 10 there is a toothed segment 18 which is welded to the arm 10. The segment 18 is arranged for engagement by the teeth of a driving pinion 23 carried by the panel plate 15. The driving pinion 23 is contained within a cover 19 and rotates upon rotation of a handle (not shown) connected directly, or indirectly by means of an adaptor plate 24, to the pinion shaft. The cover 19 also houses a spring-loaded clutch for the pinion 23 to prevent overloading thereof.

FIG. 2 depicts the regulator assembly of U.S. Pat. No. 7,010,883. Lever arms 25, 26 made by stamping sheet metal and of which the first lever arm 26 is formed as the drive arm and is connected fixedly in the region of the fixing spots (or fixing sites) 30 and 50 to an output element 27 which is formed as the toothed segment. A pot-shaped impression thereby engages through a bearing opening 40 provided in the second lever arm 25 which is designed as the guide arm, whereby an articulated joint with an articulation axis 31 is formed between the lever arms 25 and 26. The arrangement of the toothed segment 32 is selected so that its teeth 28 point in the direction of the free end of the drive arm 26, whereby the toothed segment curve 32 is dissected roughly by the driver lever 26.

The toothed segment 32 and thus also the drive arm 26 are swivel mounted in the bearing 39 of the base plate 36 through a rivet bolt 41. A rotary bearing 29 for supporting the axle of the drive pinion 42 of the drive unit 33 which comprises the gearing 34, motor 35 and electronic control unit 43 is provided in the base plate 36 corresponding to the toothed pitch diameter of the toothed segment 32. The engagement of the segment teeth 28 on the teeth of the drive pinion 42 is ensured through a slot 37 worked into the base plate 36.

As depicted in each of the above U.S. patents, the regulator assembly is mechanically secured to the vehicle door by means of a cover plate. More particularly, a cover plate secures the drive mechanism to the door panel and overlaps the mating point of the main arm toothed segment and the drive pinion. This requires the physical dimensions of the cover plate to increase and creates an undesirable addition to vehicle weight.

SUMMARY OF THE DISCLOSURE

Various details of the present disclosure are hereinafter summarized to provide a basic understanding. This summary is not an extensive overview of the disclosure, and is intended neither to identify certain elements of the disclosure, nor to delineate the scope thereof. Rather, the primary purpose of this summary is to present some concepts of the disclosure in a simplified form prior to the more detailed description that is presented hereinafter.

A window opening device for use in an automobile. The device comprises a motor having a drive gear with a drive region and a head region. The diameter of the head region is greater than the diameter of the drive region. A sector gear engages the drive region of the drive gear and is overlapped by the head region. A primary lever arm is provided and includes a drive end engaging the sector gear and a window end configured to engage a window. A pivot element is disposed between the drive end and the window end. A body plate is mounted to a door and secures the motor thereto. A first opening in the body plate accommodates the pivot element and a second opening allows the drive gear to pass through the body plate and engage the sector gear.

BRIEF DESCRIPTION OF THE DRAWINGS

The following description and drawings set forth certain illustrative implementations of the disclosure in detail, which are indicative of several exemplary ways in which the various principles of the disclosure may be carried out. The illustrated examples, however, are not exhaustive of the many possible embodiments of the disclosure. Other objects, advantages and novel features of the disclosure will be set forth in the following detailed description of the disclosure when considered in conjunction with the drawings, in which.

DETAILED DESCRIPTION

Figure 1:
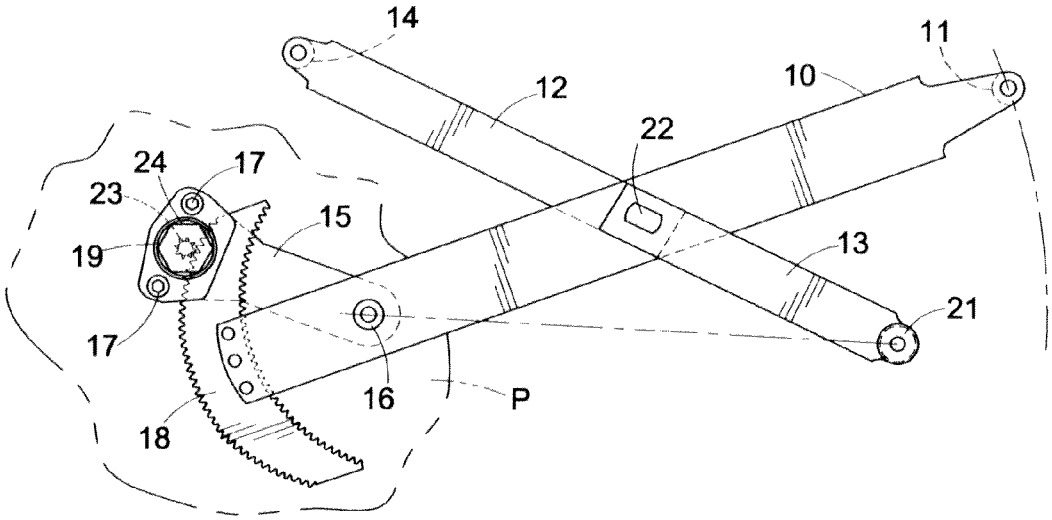
FIG. 1 (PRIOR ART)
FIG. 1 is a perspective view of a prior art regulator assembly.
Figure 2:
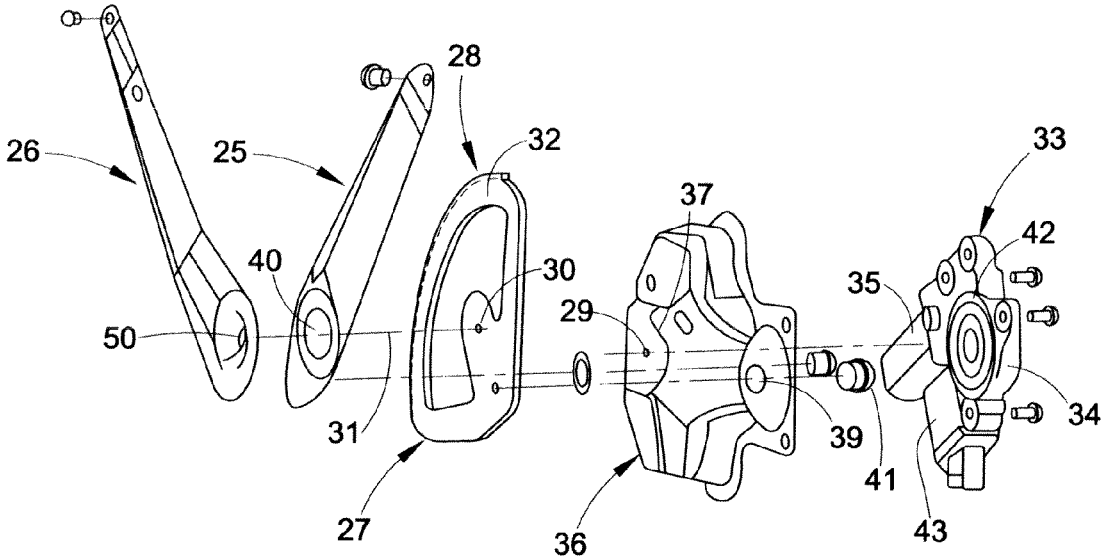
FIG. 2 (PRIOR ART)
FIG. 2 is an exploded perspective view of a prior art regulator assembly.
Figure 3:
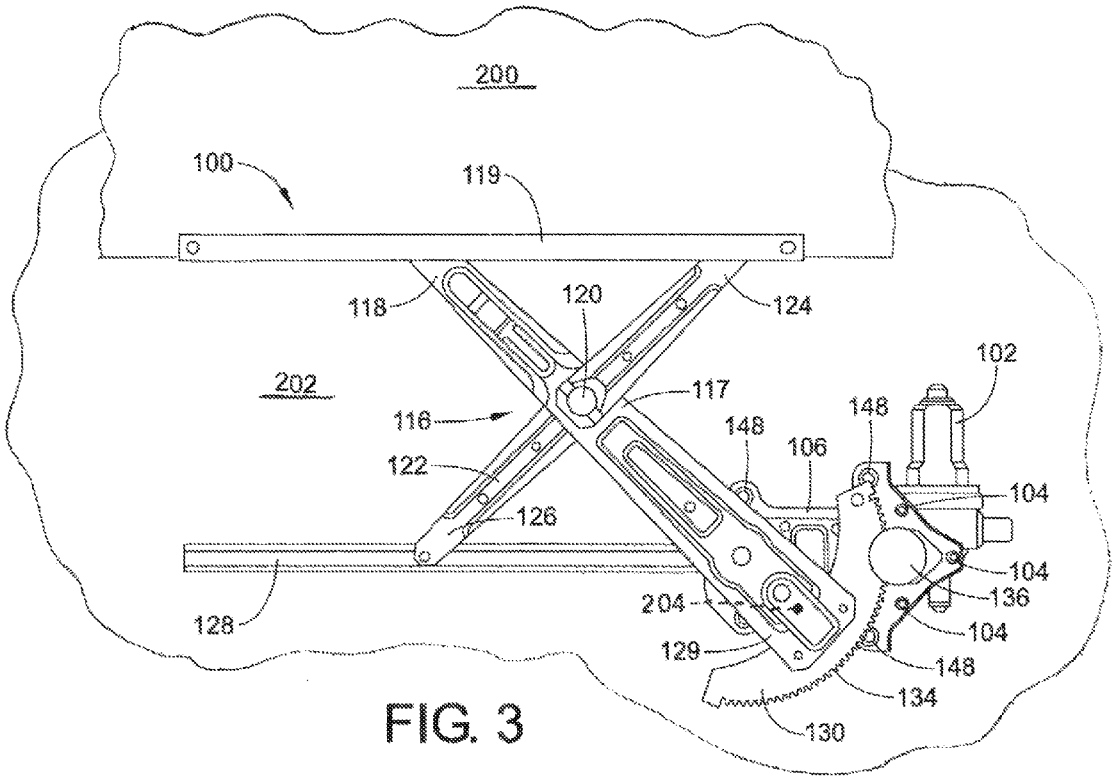
FIG. 3 is a side elevation view of the present window regulator.

One or more embodiments or implementations are hereinafter described in conjunction with the drawings, where like reference numerals are used to refer to like elements throughout, and where the various features are not necessarily drawn to scale.

A vehicle window regulator often includes a pair of rotatable arms forming a scissors linkage. A first end of the scissors linkage engages a window and a second end a drive mechanism such as a motor that is attached to the door of the vehicle. The motor rotates a gear that engages a toothed portion on the arm supporting the window, such that the motor brings about the movement of the gear and the toothed component, giving rise to the movement of the arms and, as a result, the raising or lowering of the window.

With reference to FIGS. 3-6, a window regulator is depicted. Window regulator assembly 100 includes a motor 102 having internally threaded bores 103 secured to a body plate 106 via a plurality of bolts 104 passing through holes 108. Motor 102 can be an electric motor as known to those of ordinary skill in the art, with its driving pattern controlled via a remote switch located in a vehicle passenger compartment. Motor 102 includes a drive element 110 having teeth 112. Drive element 110 extends through drive opening 114 in body plate 106.

X-link type drive arms 116 include a mail arm 117 having a window end 118 secured to a window engaging rail 119. Main are 117 is pivotally connected at 120 (for example, via rivet or pin) to guide arm 122. Guide arm 122 includes a window end 124 secured to the window engaging channel 119 receiving window 200 and a guide end 126 retained in a guide channel 128, which is secured to the door panel 202. The cooperative interaction of guide arm 122 and guide channel 128 advantageously provides a smooth operation of the apparatus.

Figure 6:
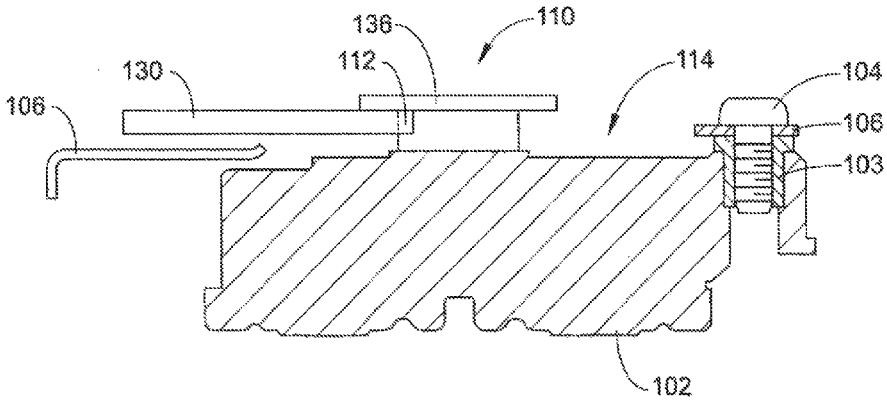
FIG. 6 is a exploded, cross-sectional view taken along line A-A of FIG. 3.
Figure 4:
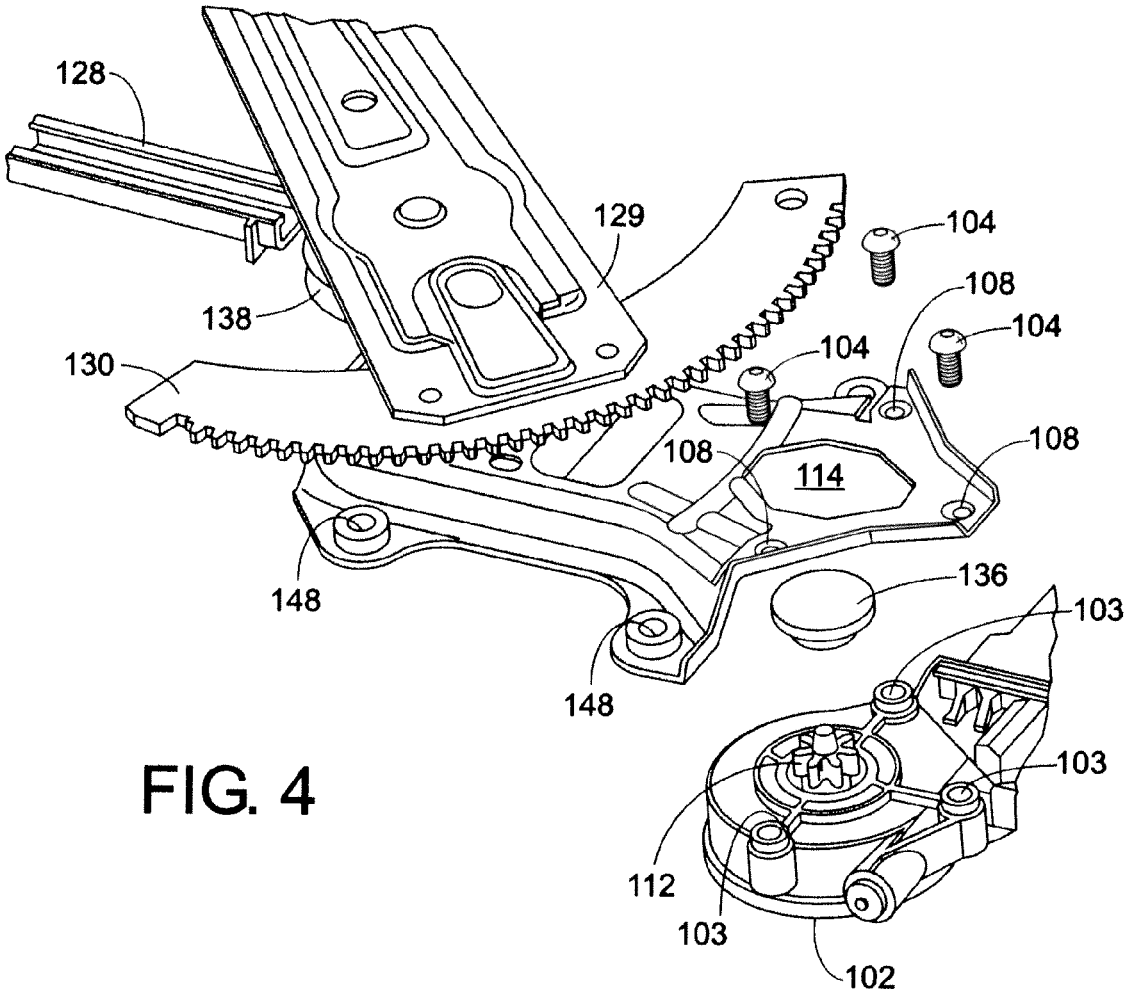
FIG. 4 is a exploded perspective view of the regulator of FIG. 3.
Figure 5:
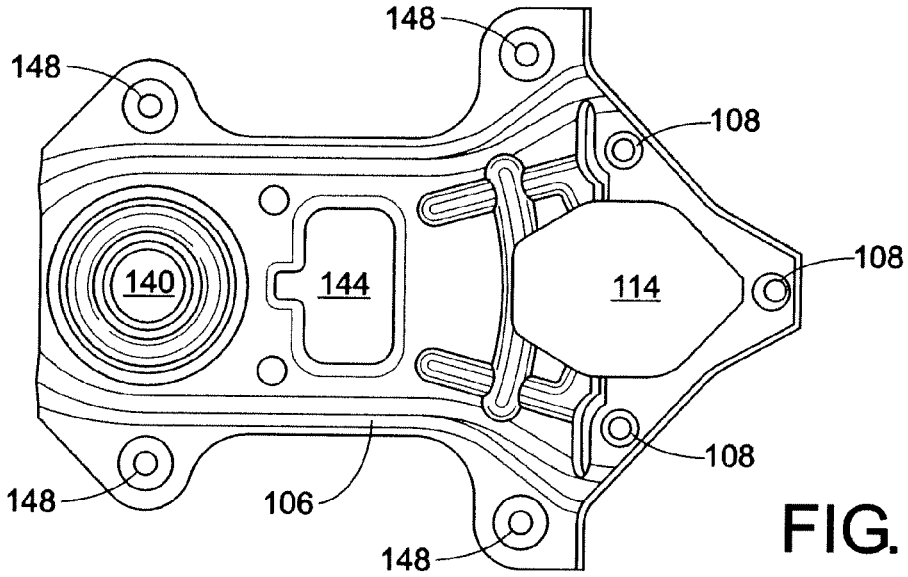
FIG. 5 is an elevation view of the body plate.

Main drive arm 117 is tapered from a drive end 129 to window end 118. Drive end 129 includes a sector gear 130. The sector gear 130 includes a curvilinear tooth region 134 which engages drive teeth 112 of drive element 110. Drive element 110 further includes a head component 136 which overlaps sector gear 130 as best seen in FIG. 6. Main drive arm 117 further includes a pivot disc 138 which is retained within a circular pivot hole 140 in body plate 106. In addition, main drive arm 116 includes a travel limiting protrusion 204 (shown in pantom) disposed between the sector gear 130 and pivot element 138 which extends into a travel limiting guide hole 144 in body plate 106. In this manner, travel of the window can be limited to a full up and a full down position in accord with the travel permitted by the extent of travel limiting guide hole 144.

Body plate 106 also includes a plurality of passages 148 to accommodate bolts (not shown) for attaching the assembly 100 to the panel (not shown) of a vehicle door. Advantageously, the present invention allows for the reduction of mass in the body plate 106. Moreover, by eliminating the mass of material at drive opening 114 and employing head component 136 on drive element 110 to retain the sector gear 130, the overall weight of the regulator assembly 100 is significantly reduced. As such, overall vehicle weight can be reduced and fuel economy improved.

The above examples are merely illustrative of several possible embodiments of various aspects of the present disclosure, wherein equivalent alterations and/or modifications will occur to others skilled in the art upon reading and understanding this specification and the annexed drawings. In particular regard to the various functions performed by the above described components (assemblies, devices, systems, and the like), the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the illustrated implementations of the disclosure. In addition, although a particular feature of the disclosure may have been illustrated and/or described with respect to only one of several implementations, such feature may be combined with one or more other features of the other implementations as may be desired and advantageous for any given or particular application. Also, to the extent that the terms "including", "includes", "having", "has", "with", or variants thereof are used in the detailed description and/or in the claims, such terms are intended to be inclusive in a manner similar to the term "comprising".

We claim:

1. A window opening device for use in an automobile door:

said device comprising a motor adjacent a panel of said door including a drive gear having a drive region and a head region, said head region being supported by said drive region and said drive region and said head region are rotatable by said motor, a diameter of said head region being greater than a diameter of said drive region;

a sector gear operatively engaging said drive region, said head region overlapping said sector gear;

a primary lever arm including a drive end engaging the sector gear and a window end configured to engage a window, a pivot element disposed between said drive end and said window end, and, a body plate mounted to said door panel, overlapping and securing said motor to said door panel, said body plate having a first side facing said door panel and receiving said motor, and an opposed second side, wherein said second side is adjacent said primary lever arm such that said motor is disposed on the first side of said body plate and said primary lever arm is disposed on the second side of the body plate, said body plate including a passage accommodating the pivot element and an opening through which said drive gear extends to facilitate engagement with said sector gear.

2. The device of claim 1 wherein said drive region includes teeth.

3. The device of claim 2 wherein said sector gear includes teeth.

4. The device of claim 1 wherein said passage is circular.

5. The device of claim 4 wherein said pivot element comprises a circular disk having a diameter greater than the diameter of said passage.

6. The device of claim 1 wherein said primary lever arm tapers continuously from drive end to window end.

7. The device of claim 1 further comprising a protrusion extending from said primary lever arm toward said body plate, said protrusion located between said sector gear and said pivot element, said body plate including a cavity into which said protrusion extends.

8. The device of claim 7 wherein said cavity is elongated.

9. The device of claim 1 including a guide arm.

10. The device of claim 9 wherein said guide arm includes a first window engaging end and a second end retained in a guide channel.

11. The device of claim 10 wherein said guide arm pivotally intersects said primary lever arm.

12. The device of claim 1 wherein said head region abuts the drive region of said drive gear.

13. The device of claim 1 wherein said head region comprises a substantially disc shaped body.

14. A window opening device for use in an automobile door, said device comprising:

a body plate mounted to a panel forming said automobile door;

a motor including a drive gear having a drive region and a head region, each of said drive region and said head region being rotatable by said motor, a diameter of said head region being greater than a diameter of said drive region;

said motor bolted to said body plate and retained between said automobile door panel and said body plate;

a primary lever arm including a drive end having a sector gear engaging the drive region of said drive gear and a window end engaging a window;

said body plate including an opening through which said drive gear extends to facilitate engagement with said sector gear and wherein said head region retains said sector gear; and, a guide arm pivotally connected to said primary lever arm and including a first end engaging a window and a second end slidably retained within a channel mounted to the automobile door.

15. The window opening device of claim 14, wherein said primary lever arm is rotatably secured to said body plate.

16. The window opening device of claim 15 wherein said body plate includes a slot receiving a projection on said lever arm to limit travel of said lever arm.

17. The window opening device of claim 14 wherein said lever arm tapers from drive end to window end.

18. The window opening device of claim 14 wherein said guide arm is comprised of a first segment extending between said channel and said primary lever arm and a second segment extending between said primary lever arm and said window.

19. The window opening device of claim 14 wherein said sector gear includes a curvilinear edge.

20. The window opening device of claim 14 wherein said head region is substantially cylindrical.

21. An automotive vehicle door window drive mechanism comprising:

an electrically powered motor including a drive gear, a cover plate overlapping said motor and securing said motor to a door panel, said cover plate including a passage accommodating said drive gear, a primary lever arm including a first end having a gear region and a second end engaging a window receiving rail, said gear region mated with said drive gear, said drive gear including a cap element retaining said primary lever arm gear region, said cap element directly connected to and extending from said drive gear such that said drive gear and said cap element are rotatable by said motor, said cover plate further including a hole receiving a pivot element extending from said primary lever arm, said cover plate including a slot receiving a protrusion from said primary lever arm and limiting travel of said primary lever arm.

* * * * *